US009812761B1

(12) United States Patent
DiCicco et al.

(10) Patent No.: US 9,812,761 B1
(45) Date of Patent: Nov. 7, 2017

(54) ARTICLE, INTEGRATED DEVICE, APPARATUS AND METHOD FOR MOUNTING A SATELLITE FEED STRUCTURE TO AN ANTENNA REFLECTOR UNIT

(71) Applicant: Globecomm Systems, Inc., Hauppauge, NY (US)

(72) Inventors: Thomas A. DiCicco, Smithtown, NY (US); Scott A. Restmeyer, Ridge, NY (US)

(73) Assignee: GLOBECOMM SYSTEMS INC., Hauppauge, NY (US)

( * ) Notice: Subject to any disclaimer, the term of this patent is extended or adjusted under 35 U.S.C. 154(b) by 0 days.

(21) Appl. No.: 14/590,956

(22) Filed: Jan. 6, 2015

(51) Int. Cl.
*H01Q 19/19* (2006.01)
*H01Q 1/08* (2006.01)
*H01Q 19/13* (2006.01)

(52) U.S. Cl.
CPC ..... *H01Q 1/088* (2013.01); *H01Q 19/13* (2013.01)

(58) Field of Classification Search
CPC ..... H01Q 1/088; H01Q 19/13
USPC ..... 343/756, 786, 834, 915; 403/43, 44, 45, 403/46; 439/314; 333/254, 255, 260
See application file for complete search history.

(56) References Cited

U.S. PATENT DOCUMENTS

2009/0163066 A1* 6/2009 Vanzo ..... H01R 13/6397 439/314
2009/0243955 A1* 10/2009 Legare ..... H01Q 1/08 343/882
2010/0178788 A1* 7/2010 Collin ..... H01R 13/62966 439/317
2011/0021057 A1* 1/2011 Katagiyama ..... H01R 13/625 439/345
2011/0081192 A1* 4/2011 Renilson ..... H01Q 1/1228 403/24
2011/0312199 A1* 12/2011 Alrutz ..... H01R 13/622 439/188

* cited by examiner

*Primary Examiner* — Dameon E Levi
*Assistant Examiner* — David Lotter
(74) *Attorney, Agent, or Firm* — Pollack, P.C.

(57) ABSTRACT

An article, integrated device, apparatus and a method for mounting a satellite antenna feed structure to an antenna reflector unit. The device comprises, in combination, a housing associated with the feed structure and a cup mounted to the antenna reflector unit. The housing includes a plurality of members projecting radially therefrom, the members being arranged and configured for cooperative engagement with slots correspondingly arranged and configured in the cup, a resilient gasket lining at least a bottom interior surface of the cup. Alternatively, the cup includes a plurality of inwardly projecting members arranged and configured for cooperative engagement with slots correspondingly arranged and configured in the housing. Upon positioning the housing axially relative to, and in mating engagement with, the cup, engaging the members with and sliding them into receiving ports of the slots, rotating the housing such that the members engage with and slide along the slots, and thereby biasing a mating portion of the housing against the gasket lining, the housing is engaged firmly within the cup.

15 Claims, 18 Drawing Sheets

ARTICLE, INTEGRATED DEVICE, APPARATUS AND METHOD FOR MOUNTING A SATELLITE FEED STRUCTURE TO AN ANTENNA REFLECTOR UNIT

This Application is a Continuation of U.S. patent application Ser. No. 14/288,312, filed May 27, 2014, which is a Continuation of U.S. patent application Ser. No. 14/074,709, filed Nov. 7, 2013, which is a Continuation of U.S. patent application Ser. No. 13/604,612, filed Sep. 5, 2012, which, in turn, is a Continuation of U.S. patent application Ser. No. 13/398,775, filed Feb. 16, 2012, which is based on and claims priority to U.S. Provisional Patent Application Ser. No. 61/463,366, filed on Feb. 16, 2011, the benefit of which are hereby claimed and the disclosures of which are hereby incorporated by reference herein in their entireties.

FIELD OF THE DISCLOSURE

This disclosure relates generally to communications systems and, more particularly, to units for mobile satellite communications and the like.

BACKGROUND OF THE DISCLOSURE

Conventional satellite antennas for mobile applications, such as portable units for field communications, require relatively small packaging and must be adaptable for rapid deployment in the field. Such antennas typically comprise an antenna reflector and an antenna feed for conveying wave energy between a transceiver (transmitter and/or receiver) and the reflector. The antenna is usually mounted to the antenna feed either permanently or removably using conventional hardware such as a brace or bracket. While mounting hardware has been found relatively useful for attaching antennas to feeds, it is often susceptible to loss or misplacement in the field, hindering or even preventing proper feed/antenna assembly. For this reason, a special tool, e.g., a screw driver or Allen key, is usually required to remove the antenna from the feed.

In the case of portable units for military applications, satellite antennas must additionally be adapted for assembly and operation under toxic or other hazardous conditions, for instance, to comply with Mission Oriented Protective Posture (or MOPP) gear protection standards. Appropriate MOPP gear protection includes, but is not limited to, special or customized gloves for use in chemical or nuclear warfare applications. Although such gloves are necessary for protection of the user during antenna deployment, they can make it difficult or even impossible to handle antenna mounting hardware, e.g., screws and other small hardware, thereby preventing the user from attaching the antenna feed to those antennas requiring mounting hardware for deployment. For this reason, tools are typically not permitted for use in assembly.

While conventional arrangements for mounting an antenna/antenna reflector to an antenna feed have been found useful, the need for special tools and mounting hardware, particularly under MOPP or other special conditions, has limited their practicality and effectiveness. Moreover, not only do the associated configurations and orientations, i.e., upon rotation, characteristic of antenna/feed assembly operation often make it difficult and costly to minimize packaging size, but they also hinder ready and reliable deployment in the field for achieving fast or even instantaneous satellite communications linkup.

OBJECTS AND SUMMARY OF THE DISCLOSURE

Accordingly, it is an object of the disclosure to provide an article, a device, an apparatus and a method for mounting a satellite antenna reflector unit to an antenna feed structure without the necessity of special tool(s) to effect their deployment, nor any mounting hardware for feed structure installation or removal operations in the field.

It is another object of the disclosure to provide an article, a device, an apparatus and a method for mounting a satellite antenna reflector unit to an antenna feed structure suitable for ready use in toxic or other hazardous environments.

It is a further object of the disclosure to provide an article, a device, an apparatus and a method for mounting a satellite antenna reflector unit to an antenna feed structure suitable for ready use by a user wearing special or customized gloves and/or with other equipment in military and/or other hazardous applications.

Still another object of the disclosure to provide an article, a device, an apparatus and a method for mounting a satellite antenna reflector unit to an antenna feed structure that requires hardware for attachment that facilitates a user's mounting of the reflector unit to the feed structure.

It is yet another object of the disclosure is to provide an article, a device, an apparatus and a method for mounting a satellite antenna reflector unit to an antenna feed structure that accommodates installation and removal of the feed structure by a user in a remote area and/or during military conflict conditions, which can make it difficult or even impossible generally to handle screws and other small hardware necessary for antenna assembly.

A further object of the disclosure is to provide an article, a device, an apparatus and a method for mounting a satellite antenna reflector unit to an antenna feed structure without the necessity of tools and mounting hardware, and associated limitations in practicality and effectiveness during field deployment of satellite antennas for mobile satellite communications applications.

It is another object of the disclosure to provide an arrangement for mounting a satellite feed structure to an antenna reflector unit that is convenient, handy and beneficial for use under MOPP or other special conditions.

It is still a further object of the disclosure to provide an arrangement for mounting a satellite antenna reflector unit to an antenna feed structure, which arrangement has a configuration and an orientation of operation that makes it simple and inexpensive to minimize packaging size, while concurrently facilitating fast, reliable and effective deployment for quick satellite communications linkup.

Yet another object of the disclosure is to provide an arrangement for mounting a satellite antenna reflector unit to an antenna feed structure, which arrangement has a configuration and variable orientation suitable for full range satellite communications linkup.

According to one embodiment, an article is provided for detachably mounting a satellite antenna feed structure to an antenna reflector unit. The article comprises a housing associated with the feed structure, the housing including a plurality of members projecting radially therefrom arranged and configured for cooperative engagement with slots correspondingly arranged and configured in a cup mounted to the antenna reflector unit, the cup having a resilient gasket lining at least a bottom interior surface thereof. Upon positioning the housing axially relative to, and in mating engagement with, the cup, engaging the members with, and sliding them into, receiving ports of the slots, rotating the housing such that the members engage with and slide along the slots, and thereby biasing a mating portion of the housing against the resilient gasket lining of the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

In accordance with another arrangement, an integrated device is provided for detachably mounting a satellite antenna feed structure to an antenna reflector unit. The device comprises, in combination, a housing associated with the feed structure and a cup mounted to the antenna reflector unit. The housing includes a plurality of members projecting radially therefrom, the members being arranged and configured for cooperative engagement with slots correspondingly arranged and configured in the cup, a resilient gasket lining at least a bottom interior surface of the cup. Upon positioning the housing axially relative to, and in mating engagement with, the cup, engaging the members with and sliding them into receiving ports of the slots, rotating the housing such that the members engage with and slide along the slots, and thereby biasing a mating portion of the housing against the resilient gasket lining of the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

According to a further embodiment, a portable, mobile communications apparatus is provided which comprises a protective enclosure for retractable access to a satellite feed structure, an antenna reflector unit, and an integrated device for detachably mounting the feed structure to the reflector unit, the enclosure having a base and a cover hingedly attached to the base for accessing the structure, unit and device between open and closed positions. The device comprises, in combination, a housing associated with the feed structure and a cup mounted to the antenna reflector unit. The housing includes a plurality of members projecting radially therefrom, the members being arranged and configured for cooperative engagement with slots correspondingly arranged and configured in the cup, a resilient gasket lining at least a bottom interior surface of the cup. Upon positioning the housing axially relative to, and in mating engagement with, the cup, engaging the members with and sliding them into receiving ports of the slots, rotating the housing such that the members engage with and slide along the slots, and thereby biasing a mating portion of the housing against the resilient gasket lining of the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

In addition, there is provided an article for detachably mounting a satellite antenna feed structure to an antenna reflector unit. The article comprises a cup mounted to the antenna reflector unit, the cup having a plurality of inwardly projecting members arranged and configured for cooperative engagement with slots correspondingly arranged and configured in a housing associated with the feed structure. The cup also has a resilient gasket lining at least a bottom interior surface thereof. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

According to yet another arrangement, an integrated device is provided for detachably mounting a satellite antenna feed structure to an antenna reflector unit. The device comprises, in combination, a housing associated with the feed structure and a cup of the antenna reflector unit. The cup includes a plurality of inwardly projecting members arranged and configured for cooperative engagement with slots correspondingly arranged and configured in the housing, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

In accordance with still another embodiment, a portable, mobile communications apparatus is provided which comprises a protective enclosure for retractable access to a satellite feed structure, an antenna reflector unit, and an integrated device for detachably mounting the feed structure to the reflector unit, the enclosure having a base and a cover hingedly attached to the base for accessing the structure, unit and device between open and closed positions. The device comprises, in combination, a housing associated with the feed structure and a cup of the antenna reflector unit. The cup includes a plurality of inwardly projecting members arranged and configured for cooperative engagement with slots correspondingly arranged and configured in the housing, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

According to yet a further aspect, an article is provided for detachably mounting a satellite antenna feed structure to an antenna reflector unit of an antenna assembly. The article comprises an antenna assembly mounting a plurality of members projecting inwardly or radially therefrom, and separately from the feed structure and the reflector unit, the assembly having a cup shaped portion with a resilient gasket lining at least a bottom interior surface thereof. The members are arranged and configured for cooperative engagement with slots correspondingly arranged and configured in the feed structure, the reflector unit and/or component(s) thereof, whereupon positioning the housing axially relative to the cup portion and in mating engagement therewith, sliding the members into receiving ports of the slots, rotating the housing and/or cup portion such that the members engage with and slide along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

In accordance with still a further arrangement, an integrated device is provided for detachably mounting a satellite antenna feed structure to an antenna reflector unit of an antenna assembly. The device comprises, in combination, a housing associated with the feed structure and a cup portion of the antenna assembly. A plurality of members are mounted to the antenna assembly, separately from the feed structure and the reflector unit, such members projecting inwardly or radially from the assembly. The members are arranged and configured for cooperative engagement with slots correspondingly arranged and configured in the feed structure, the reflector unit and/or component(s) thereof. A resilient gasket lines at least a bottom interior surface of the cup portion. Upon positioning the housing axially relative to the cup portion and in mating engagement therewith, sliding the members into receiving ports of the slots, rotating the housing and/or cup portion such that the members engage with and slide along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

A portable, mobile communications apparatus is also provided which comprises a protective enclosure for retractable access to a satellite feed structure, an antenna reflector unit of an antenna assembly, and an integrated device for detachably mounting the feed structure to the reflector unit, the enclosure having a base and a cover hingedly attached to the base for accessing the structure, unit and device between open and closed positions. The apparatus comprises, in combination, a housing associated with the feed structure and a cup shaped portion of the antenna assembly. A plurality of members are mounted to the antenna assembly, separately from the feed structure and the reflector unit, such members projecting inwardly or radially from the assembly. The members are arranged and configured for cooperative engagement with slots correspondingly arranged and configured in the feed structure, the reflector unit, and/or component(s) thereof. A resilient gasket lines at least a bottom interior surface of the cup portion. Upon positioning the housing axially relative to the cup portion and in mating engagement therewith, sliding the members into receiving ports of the slots, rotating the housing and/or cup portion such that the members engage with and slide along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

According to another arrangement, a method is provided for detachably mounting a satellite antenna feed structure to an antenna reflector unit. Initially, the feed structure is provided with a housing, and a cup is associated with the antenna reflector unit. A plurality of members are then mounted to the housing and slots are formed in the cup. The members are mounted so as to project radially therefrom, being arranged and configured for cooperative engagement with slots correspondingly arranged, formed and configured in the cup, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

In accordance with yet another embodiment, a method is provided for detachably mounting a satellite antenna feed structure to an antenna reflector unit. Initially, the feed structure is provided with a housing, and a cup is associated with the antenna reflector unit. The cup includes a plurality of members projecting radially therefrom, the members being arranged and configured for cooperative engagement with slots correspondingly arranged and configured in the housing, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

In a further embodiment, a method is provided for detachably mounting a satellite antenna feed structure to an antenna reflector unit of an antenna assembly. A plurality of members are initially mounted to the antenna assembly, separately from the feed structure and the reflector unit, such members projecting inwardly or radially from the assembly.

The members are arranged and configured for cooperative engagement with slots correspondingly arranged and configured in the feed structure, the reflector unit and/or component(s) thereof. The assembly is provided with a cup shaped portion, a resilient gasket lining at least a bottom interior surface thereof. Upon positioning the housing axially relative to the cup portion and in mating engagement therewith, engaging the members with, and sliding them into, receiving ports of the slots, rotating the housing such that the members engage with and slide along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

According to another alternative embodiment, a method is provided for dismounting a satellite antenna feed structure from an antenna reflector unit. First, a housing associated with the feed structure is grasped by the user, pushed in a generally downward direction so as to overcome a frictional biasing force, and rotated in a direction such that members projecting radially from the housing, which members are in engagement with slots in a cup associated with the antenna feed structure and having a resilient gasket lining at least a bottom portion thereof, slide along the slots. Second, rotation is continued by the user such that the members slide along the slots toward member receiving ports of the slots. Upon reaching and engaging the member receiving slots, the housing is pulled axially by the user, thereby disengaging the members from the slots and the housing from the cup.

According to another aspect of this method, the user initially grasps the housing associated with the feed structure, pushes the housing in a generally downward direction so as to overcome a frictional biasing force, and rotates the same in a direction such that members projecting inwardly from a cup associated with the antenna reflector unit and having a resilient gasket lining at least a bottom portion thereof, which members are in engagement with slots in the housing, slide along the slots. Rotation is then continued such that the members slide along the slots toward member receiving ports of the slots. Upon reaching and engaging the member receiving slots, the user pulls the housing axially, thereby disengaging the members from the slots and the housing from the cup.

In the case where the members project inwardly or radially from an antenna assembly, which members are in engagement with slots in the feed structure, reflector unit and/or component(s) thereof, the user similarly grasps the housing, pushes the housing in a generally downward direction so as to overcome a frictional biasing force, and rotates the same such that the members slide along the slots. Rotation is continued such that the members slide along the slots toward member receiving ports of the slots. Upon reaching and engaging the member receiving slots, grasping the housing and disengaging the members from the slots and the housing from the antenna assembly.

Alternatively or concurrently with each of the foregoing methods, a portable, mobile communications apparatus is provided which comprises a protective enclosure for retractable access to a satellite feed structure, an antenna reflector unit, and an integrated device for detachably mounting the feed structure to the reflector unit, the enclosure having a base and a cover hingedly attached to the base for accessing the structure, unit and device between open and closed positions. The apparatus comprises, in combination, a housing associated with the feed structure and a cup of the antenna reflector unit.

The present article, integrated device, apparatus and method will now be further illustrated by the following drawings which are not intended to limit this disclosure.

BRIEF DESCRIPTION OF THE DRAWINGS

The same numerals are used throughout the figure drawings to designate similar elements. Still other objects and advantages of the this disclosure will become apparent from the following description of the preferred embodiments.

DETAILED DESCRIPTION

Figure 1:
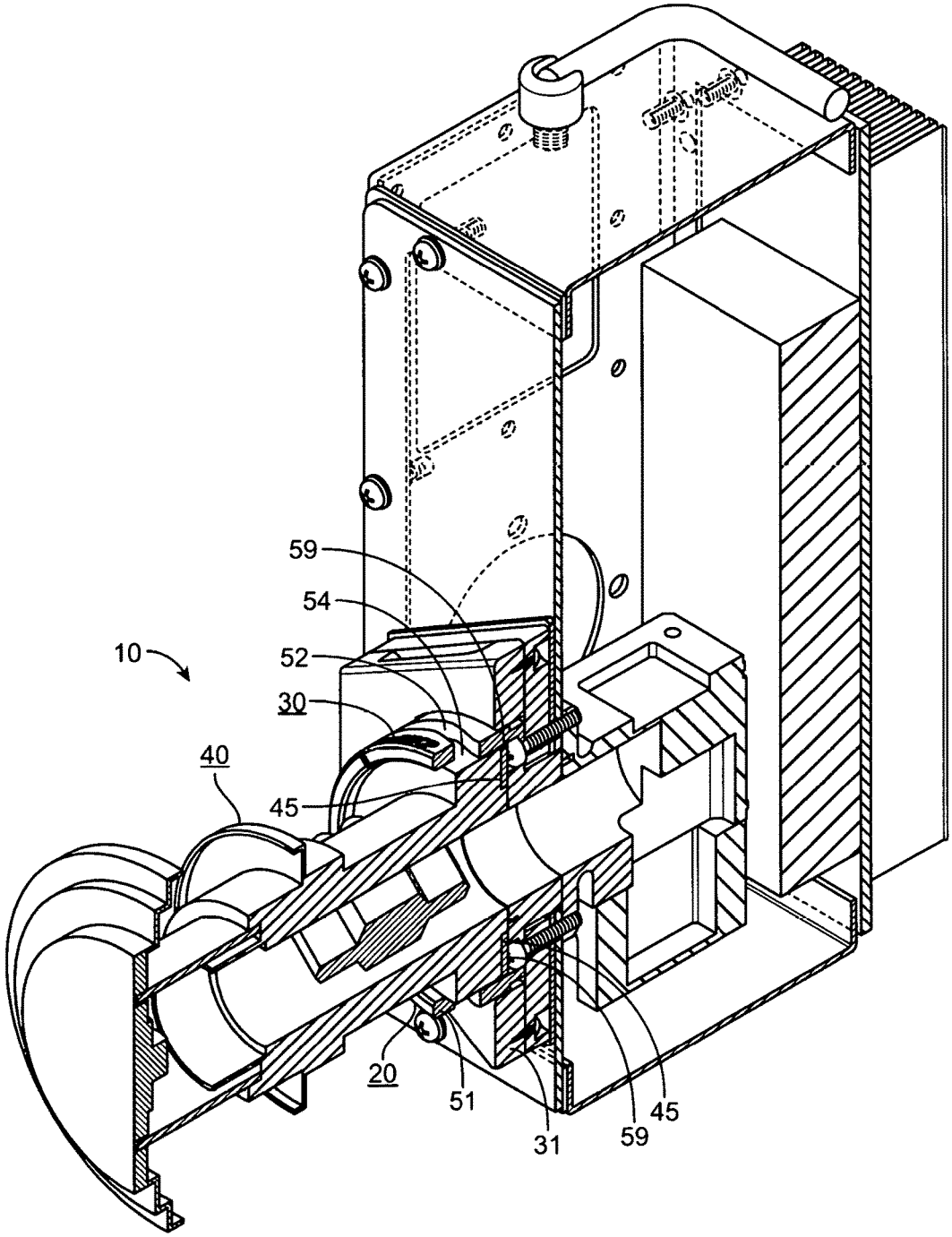
FIG. 1 is a perspective view of an antenna hub assembly, including an article and integrated device for mounting a satellite antenna feed structure to an antenna reflector unit, according to one aspect of the disclosure.

Generally speaking, in mobile satellite communications, the term "antenna feed" refers to components between an antenna and an amplifier (HPA and LNB or LNA). Alternatively or concurrently, the antenna feed may include a horn antenna (or feedhorn), an orthomode transducer, a polarizator, frequency diplexer, a waveguide, waveguide switches, rotary joint, and/or like components.

The feedhorn is preferably used to convey radio waves between a transceiver (transmitter and/or receiver) and an antenna reflector. More specifically, it selects the polarity of waves to be received, which helps attenuate unwanted signals from adjacent channels and transponders, and from other communications satellites at nearby orbital positions. If polarization is linear, reception can be accomplished either horizontally or vertically, whereas if polarization is circular, it can be performed in a clockwise or counterclockwise (or left- and right-handed) orientation. As will be appreciated by those skilled in the art, other conventional devices may be included generally and/or to allow the feedhorn to accept signals both linear and circular, even though such devices may cause slight insertion loss to incoming signals.

With a parabolic antenna reflector (or a lens type antenna), the phase center of the feedhorn is typically located at the focal point of the reflector, with the, e.g., 3 dB, points of the feedhorn's radiation pattern set at the reflector edge. On a satellite dish, for instance, the feedhorn is mounted to the end of a mast that extends from the center of the dish, or on tripod legs mounted to the edge of the dish. Alternatively or concurrently, the feedhorn is part of an LNBF where it is combined with a low-noise blockconverter (LNB).

A parabolic antenna is a high-gain reflector type antenna used not only for radio, television and data communications, but also for radiolocation (radar), on the UHF and SHF parts of the electromagnetic spectrum. The relatively short wavelength of electromagnetic radiation at these frequencies allows reasonably sized reflectors to exhibit a highly directional response as is often desired for both reception and transmission.

Early applications of parabolic antennas included ground-based radar, airborne radar and radio astronomy. With the advent of TVRO and DBS satellite television, the parabolic antenna became prevalent in urban, suburban, and even rural areas. These antennas have also been proliferated with extensive terrestrial microwave links, such as those between cellphone base stations, and wireless WAN/LAN applications.

Although the term "dish antenna" is often used to denote a parabolic antenna, it can refer to a spherical antenna as well, which reflector shape has at least one portion of spherical surface. The reflector is usually a metallic surface formed into a paraboloid of revolution and truncated in a circular rim that forms the diameter of the antenna. This paraboloid possesses a distinct focal point by virtue of having the reflective property of parabolas in that a point light source at this focus produces a parallel light beam aligned with the axis of revolution.

A parabolic antenna typically consists of a parabolic reflector with a small feed antenna at its focus. The feed antenna is often a low-gain type such as a half-wave dipole or a small waveguide horn. In more complex designs, such as a Cassegrain antenna, a sub-reflector is used to direct the energy into the parabolic reflector from a feed antenna located away from the primary focal point. The feed antenna is then connected to the associated radio-frequency (RF) transmitting or receiving equipment via a coaxial cable transmission line or hollow waveguide.

The foregoing discussion is provided to illustrate possible applications of the disclosure, but not to limit its intended environment.

Figure 2:
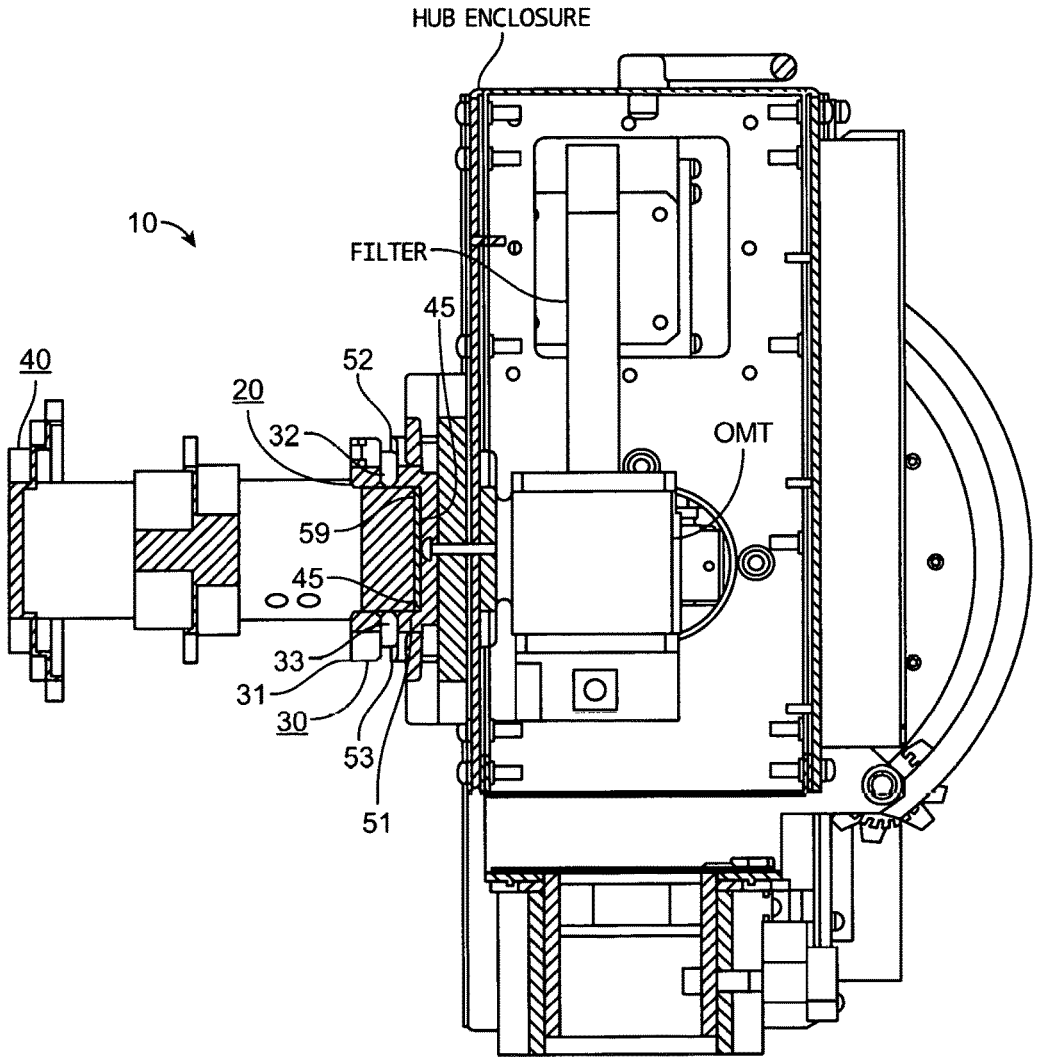
FIG. 2 is a side view of the hub assembly shown in FIG. 1.
Figure 3:
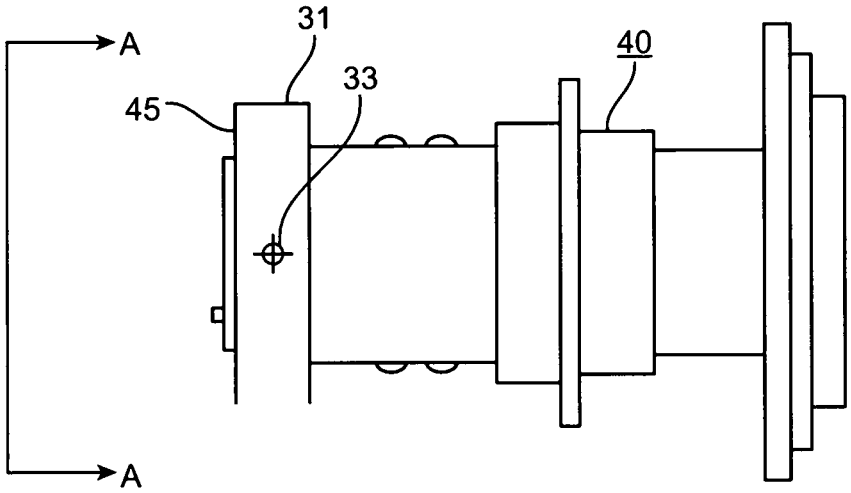
FIG. 3 is a side view of the article illustrated in FIG. 1 which comprises a housing associated with the feed structure, the housing including a plurality of members projecting radially therefrom.
Figure 4:
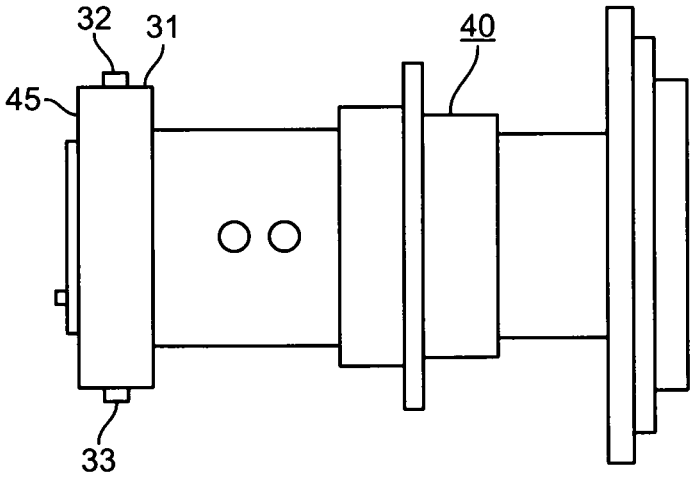
FIG. 4 is a side view of the housing illustrated in FIG. 3, rotated 90 degrees relative thereto.
Figure 5:
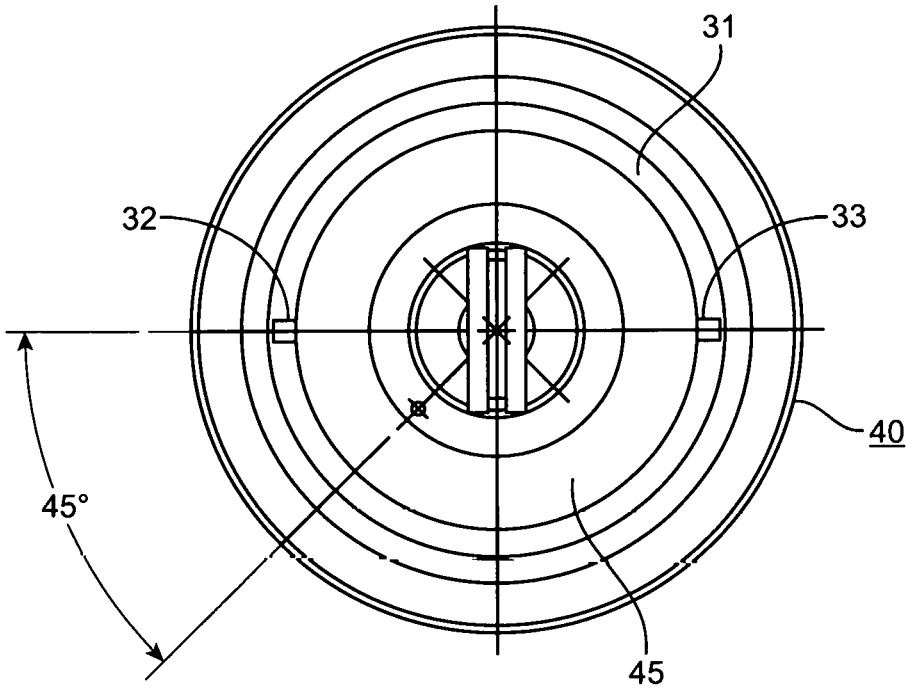
FIG. 5 is an end view of the housing taken along line A-A of FIG. 3.
Figure 6:
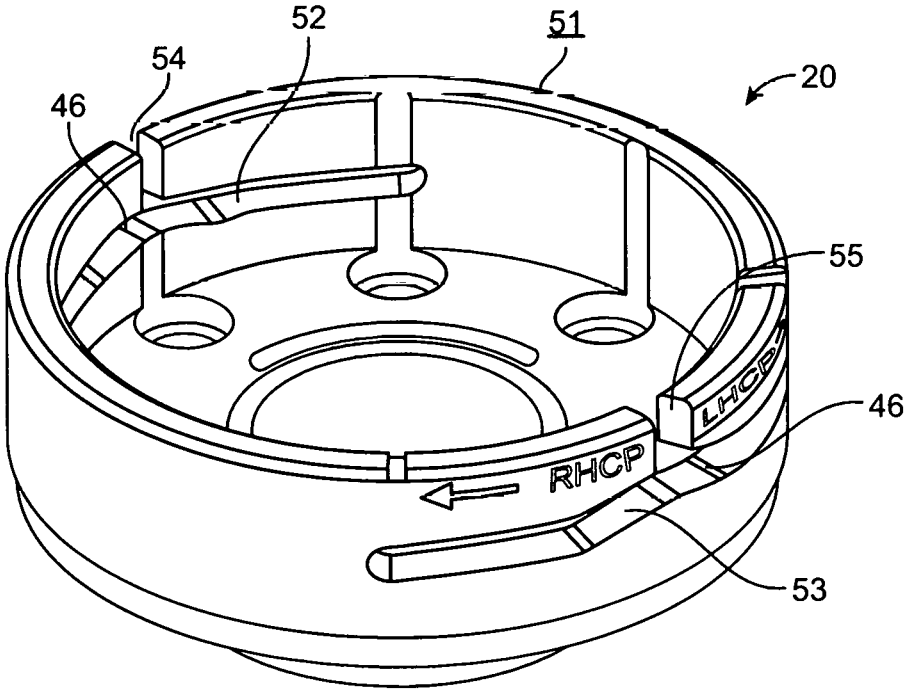
FIG. 6 is a perspective view of a cup associated with the antenna reflector unit, the cup having slots for cooperative engagement with the members projecting from the housing set forth in FIG. 3.
Figure 7:
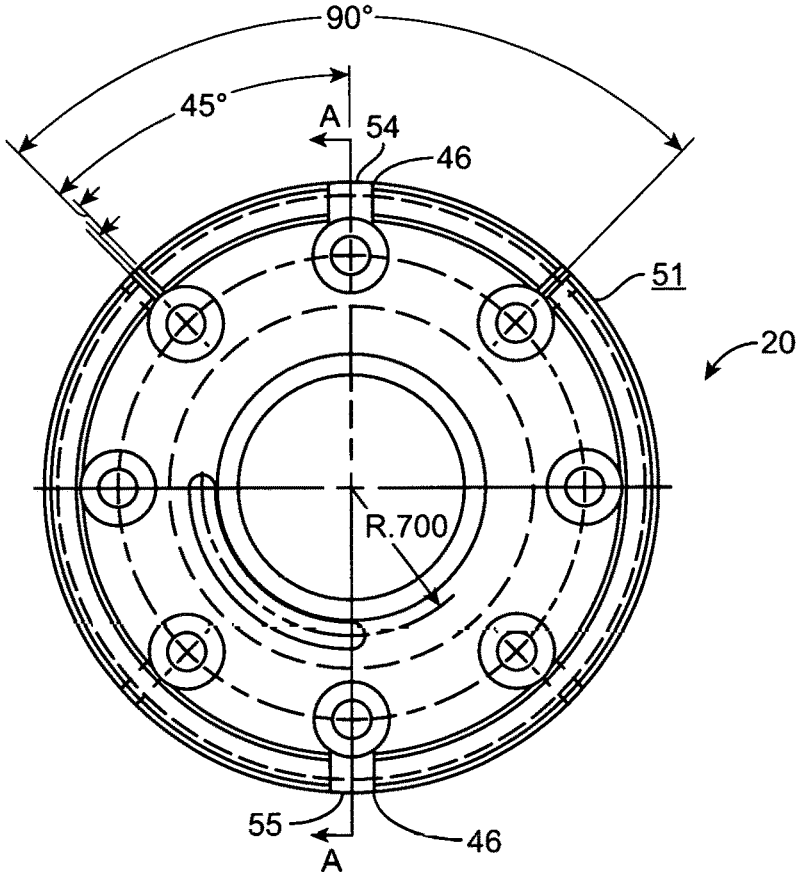
FIG. 7 is a front plan view of the cup illustrated in FIG. 6, showing interior portions thereof.
Figure 8:
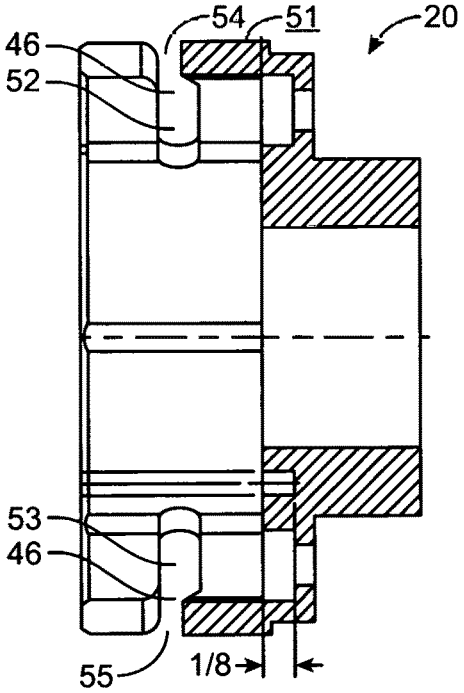
FIG. 8 is a side sectional view of the cup taken along line A-A of FIG. 7.
Figure 9:
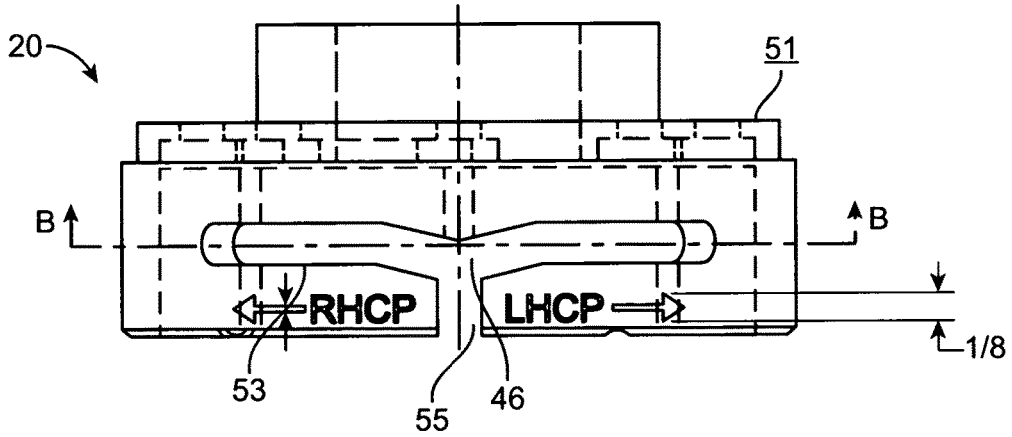
FIG. 9 is a side view of the cup shown in FIG. 6, illustrating a first of the slots for cooperative engagement with the members projecting from the housing.
Figure 10:
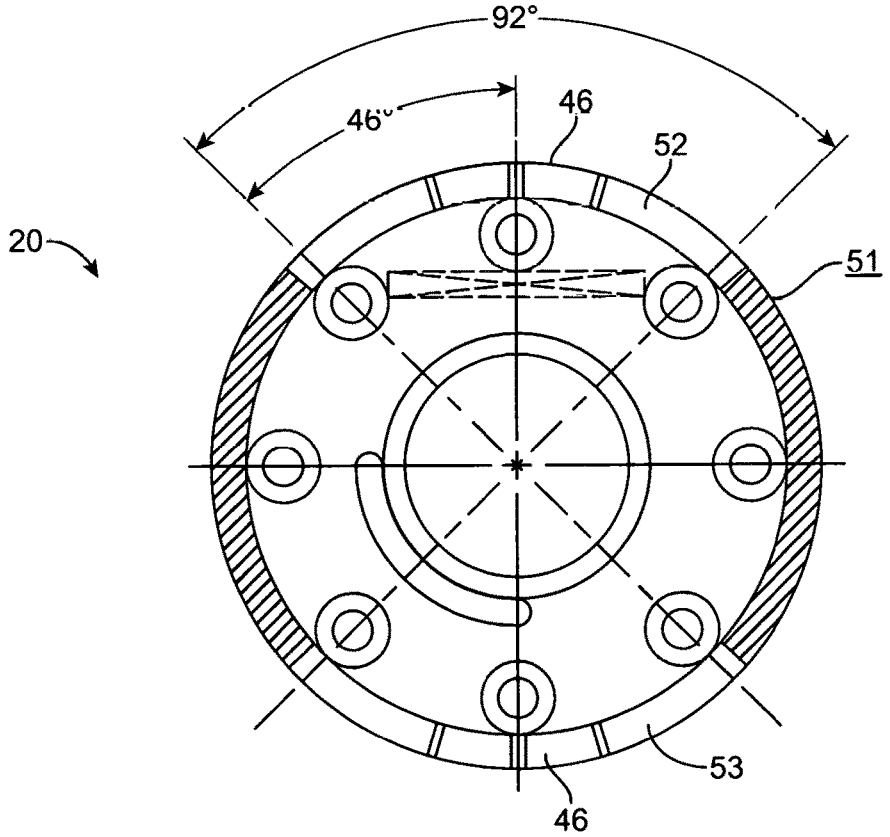
FIG. 10 is a sectional view taken along line B-B of FIG. 9.
Figure 11:
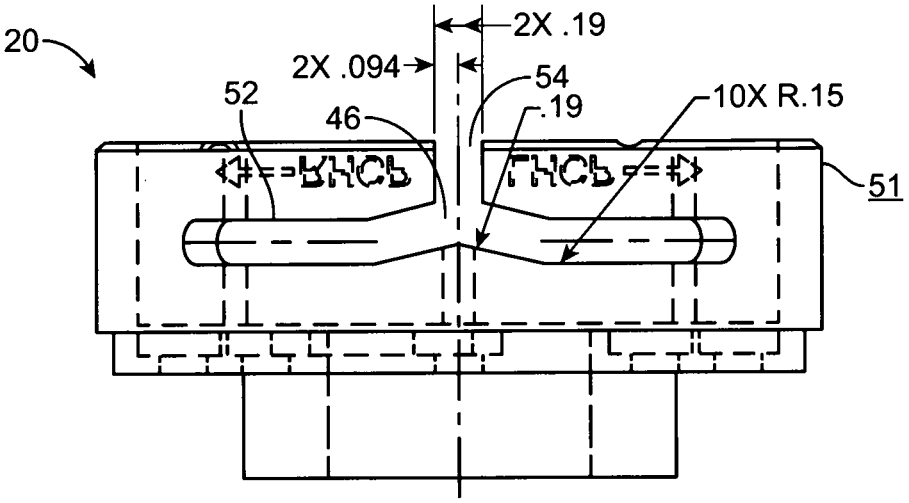
FIG. 11 is an inverted, opposing side view of the cup set forth in FIG. 9, showing a second of the slots for cooperative engagement with the members projecting from the housing.
Figure 12:
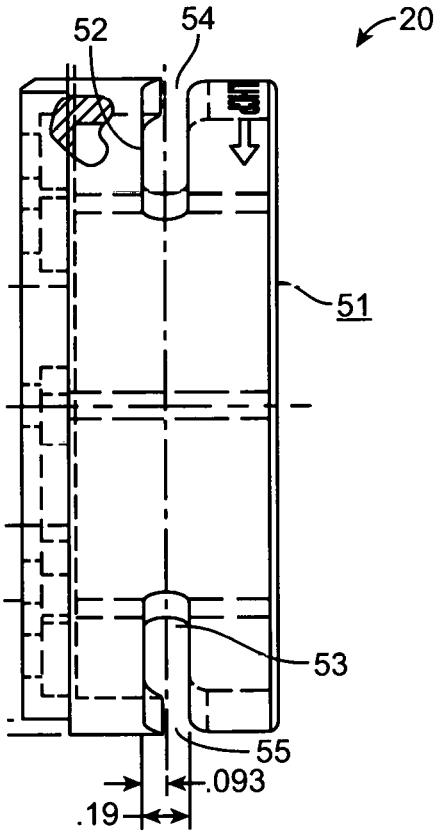
FIG. 12 is a side view of the cup illustrated in FIG. 9, rotated 90 degrees relative thereto.
Figure 13:
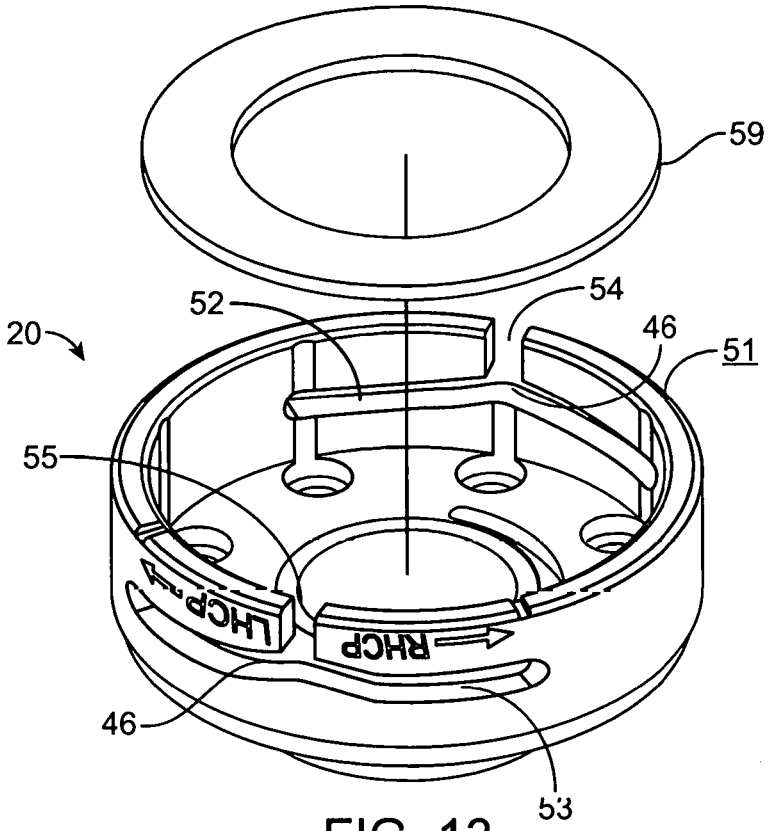
FIG. 13 is an exploded perspective view of a cup and resilient gasket, according to various aspects of the disclosure.
Figure 14:
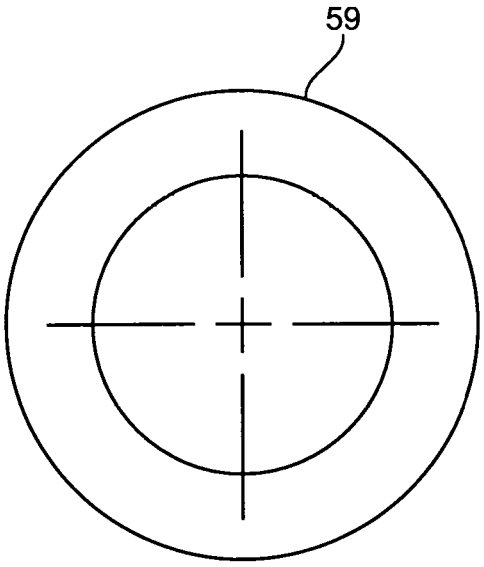
FIG. 14 is a plan view of the resilient gasket shown in FIG. 13.
Figure 15:
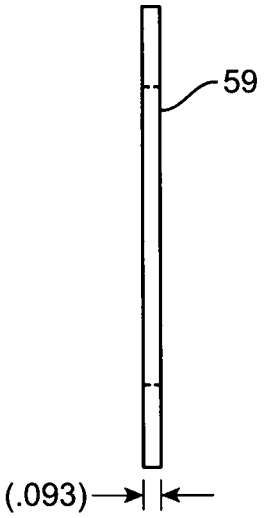
FIG. 15 is a side view of the resilient gasket illustrated in FIG. 14.
Figure 18:
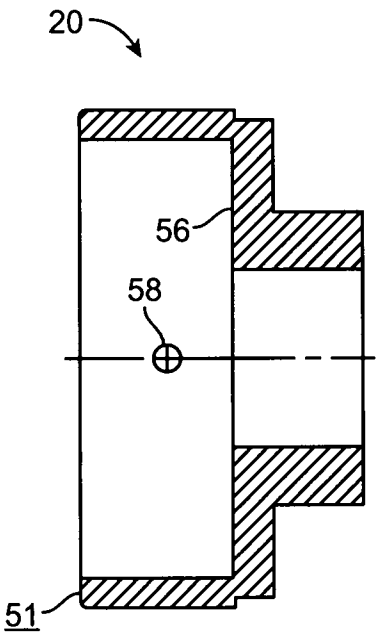
FIG. 18 is a side sectional view of the cup taken along line A-A of FIG. 17.
Figure 17:
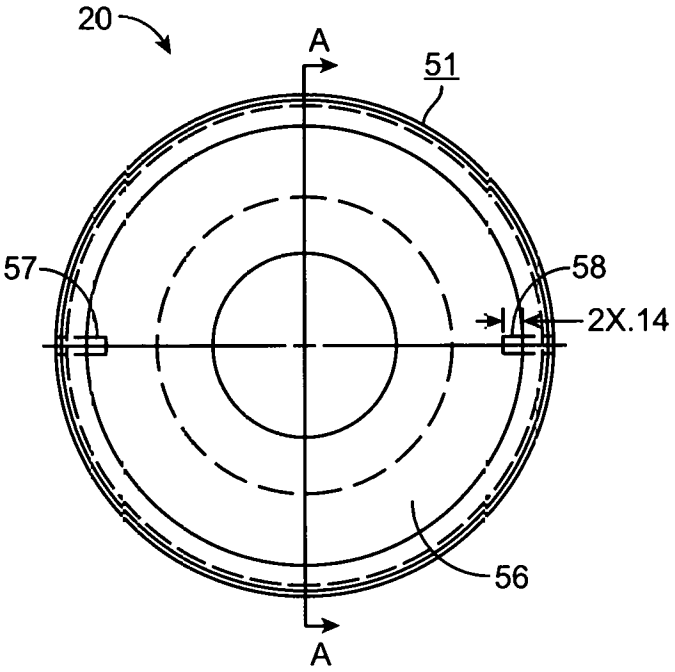
FIG. 17 is a front plan view of the cup illustrated in FIG. 16, showing interior portions thereof.
Figure 16:
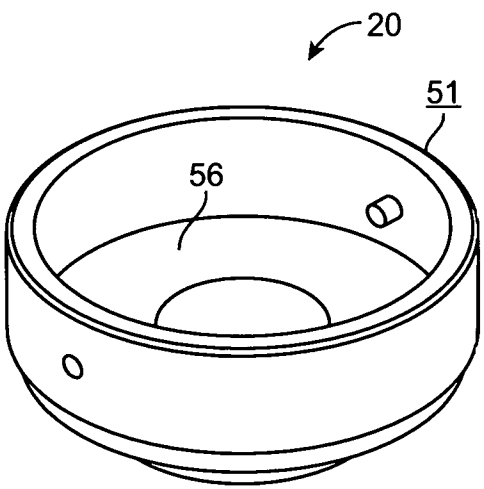
FIG. 16 is a perspective view of an article for the antenna hub assembly of FIG. 1, according to another embodiment of the disclosure, the article comprising a cup having a plurality of inwardly projecting members.
Figure 19:
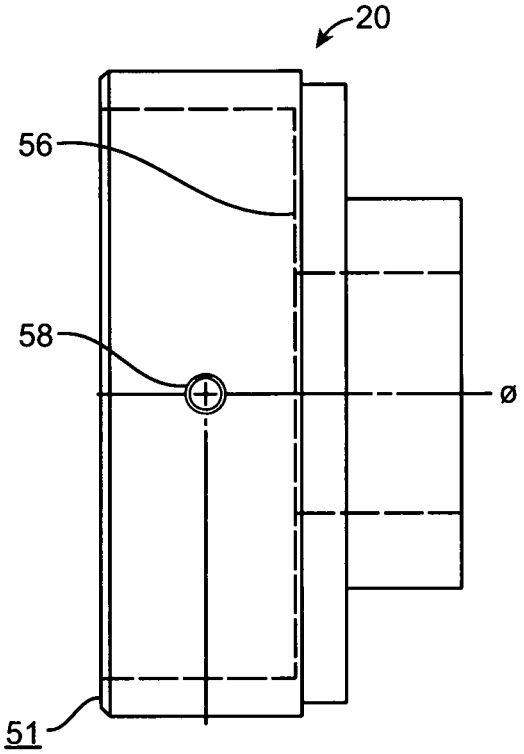
FIG. 19 is a side view of the cup shown in FIG. 16, illustrating a first of the slots for cooperative engagement with the members projecting from the housing.
Figure 20:
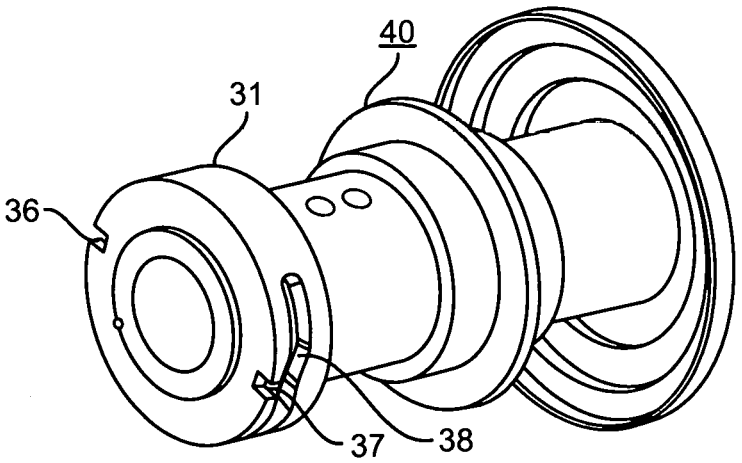
FIG. 20 is a perspective view of a housing associated with the feed structure, the housing having slots for cooperative engagement with the inwardly projecting members of the cup illustrated in FIG. 16.
Figure 21:
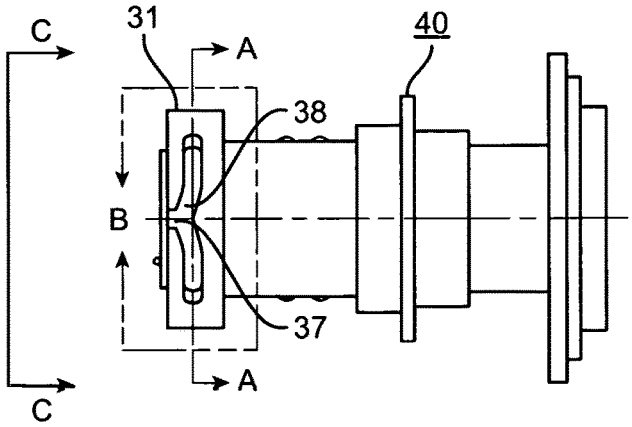
FIG. 21 is a side view of the housing shown in FIG. 20.
Figure 22:
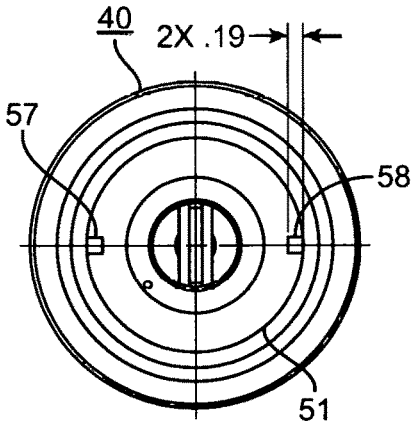
FIG. 22 is an end view of the housing taken along line C-C of FIG. 21.
Figure 23:
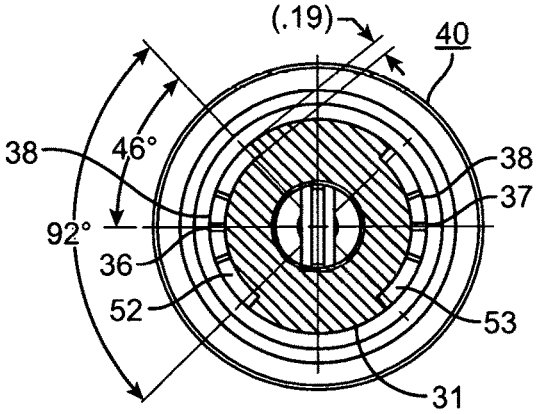
FIG. 23 is a sectional view of the housing taken along line A-A of FIG. 21.
Figure 24:
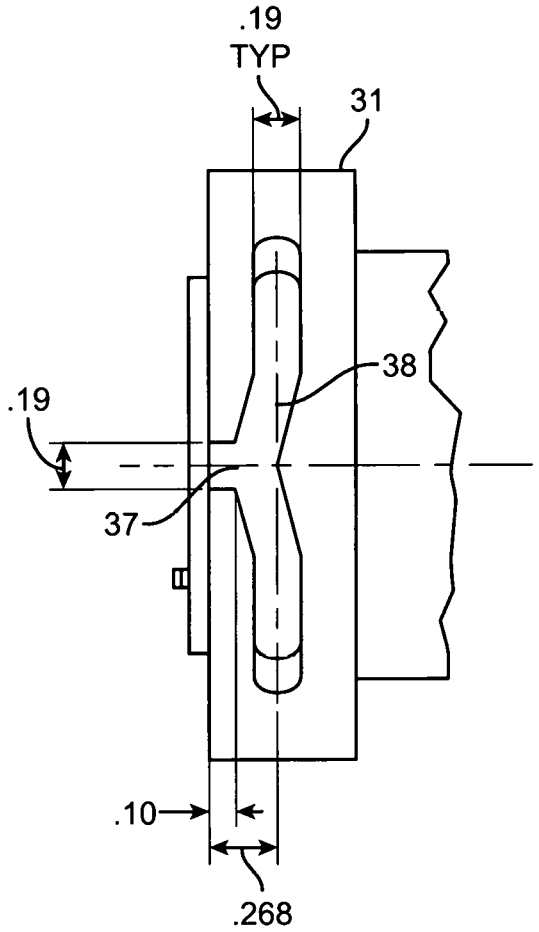
FIG. 24 is an enlarged view of a section taken at line B of FIG. 21.
Figure 25:
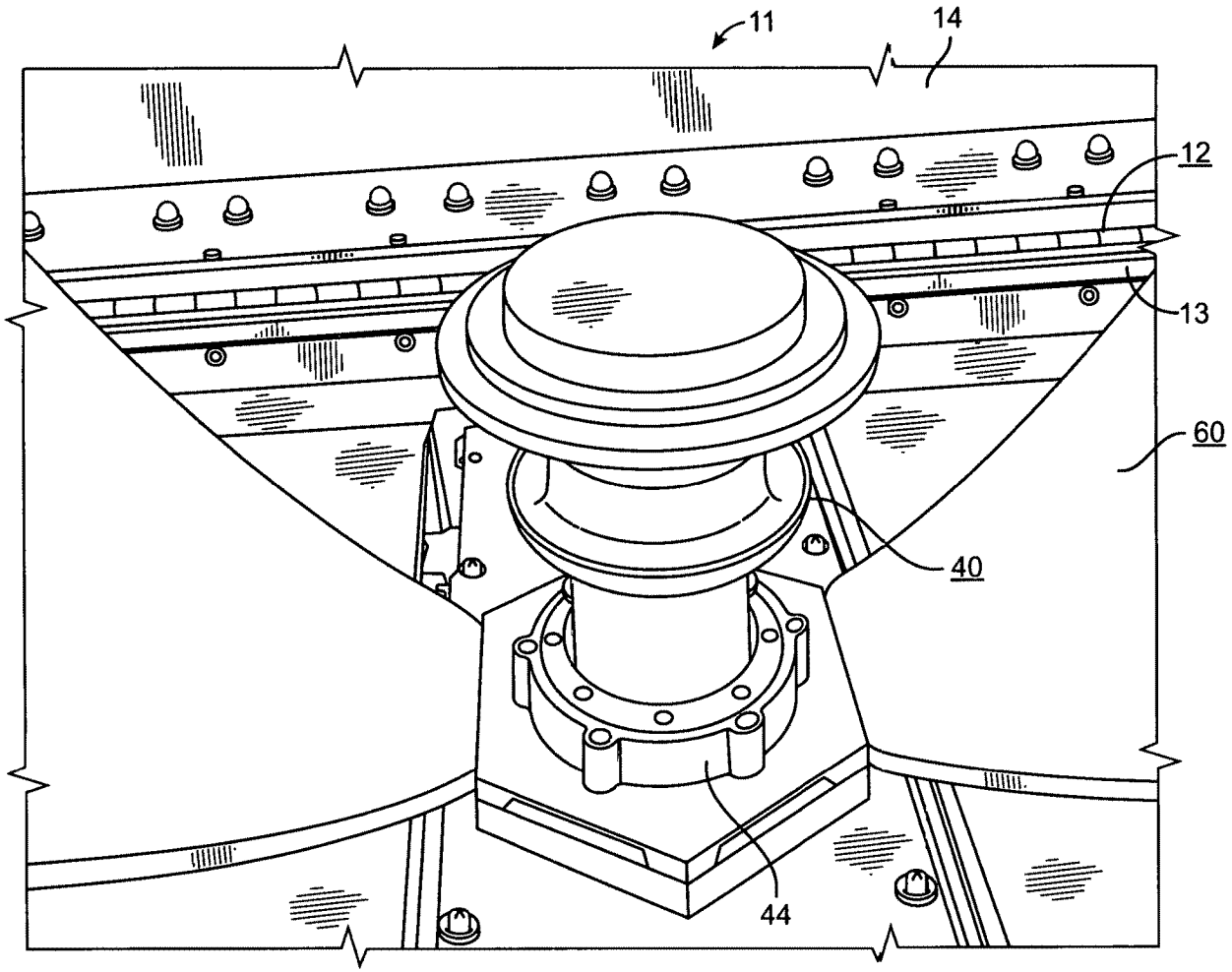
FIG. 25 is a perspective view of an integrated device comprising, in combination, a housing associated with the feed structure and a cup mounted to the antenna reflector unit.
Figure 26:
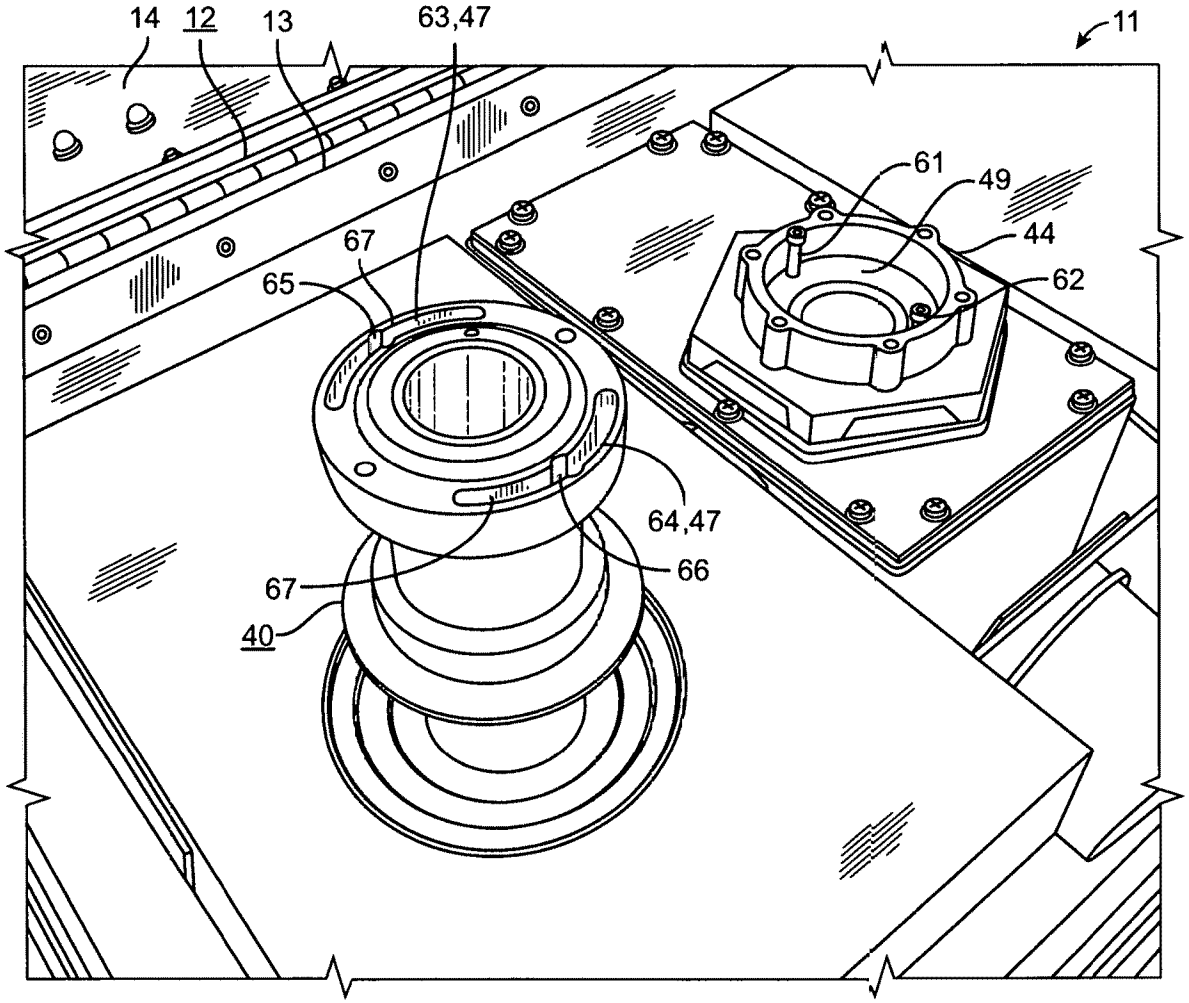
FIG. 26 is a perspective view of housing and cup components of the device illustrated in FIG. 25, prior to integration.
Figure 27:
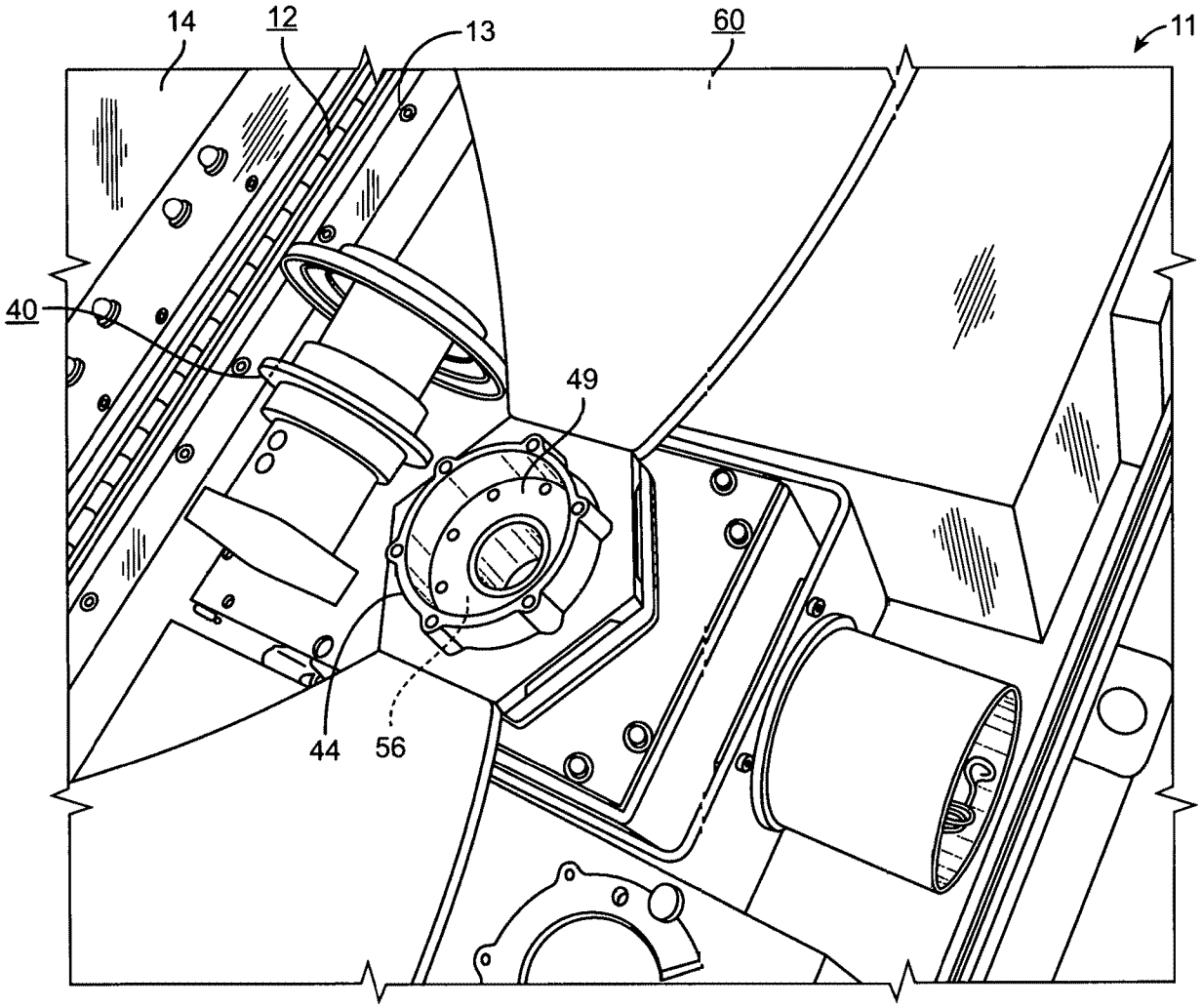
FIG. 27 is an alternative perspective view of the housing and cup components of the device shown in FIG. 25, prior to integration, with a partially assembled antenna reflector unit.
Figure 28:
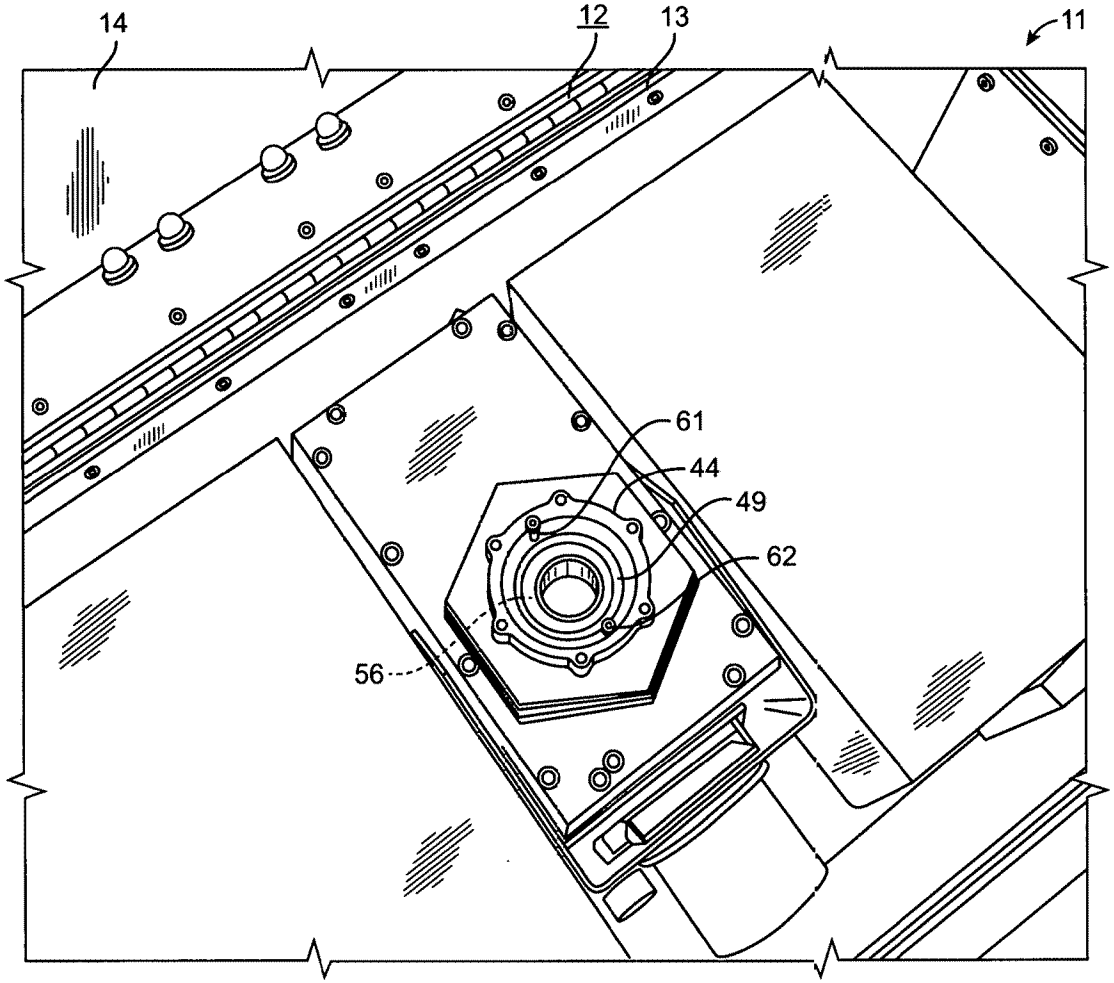
FIG. 28 is a further alternative perspective view of the cup component of the device illustrated in FIG. 25, the cup being mounted to the base of the antenna reflector unit, prior to assembly.
Figure 29:
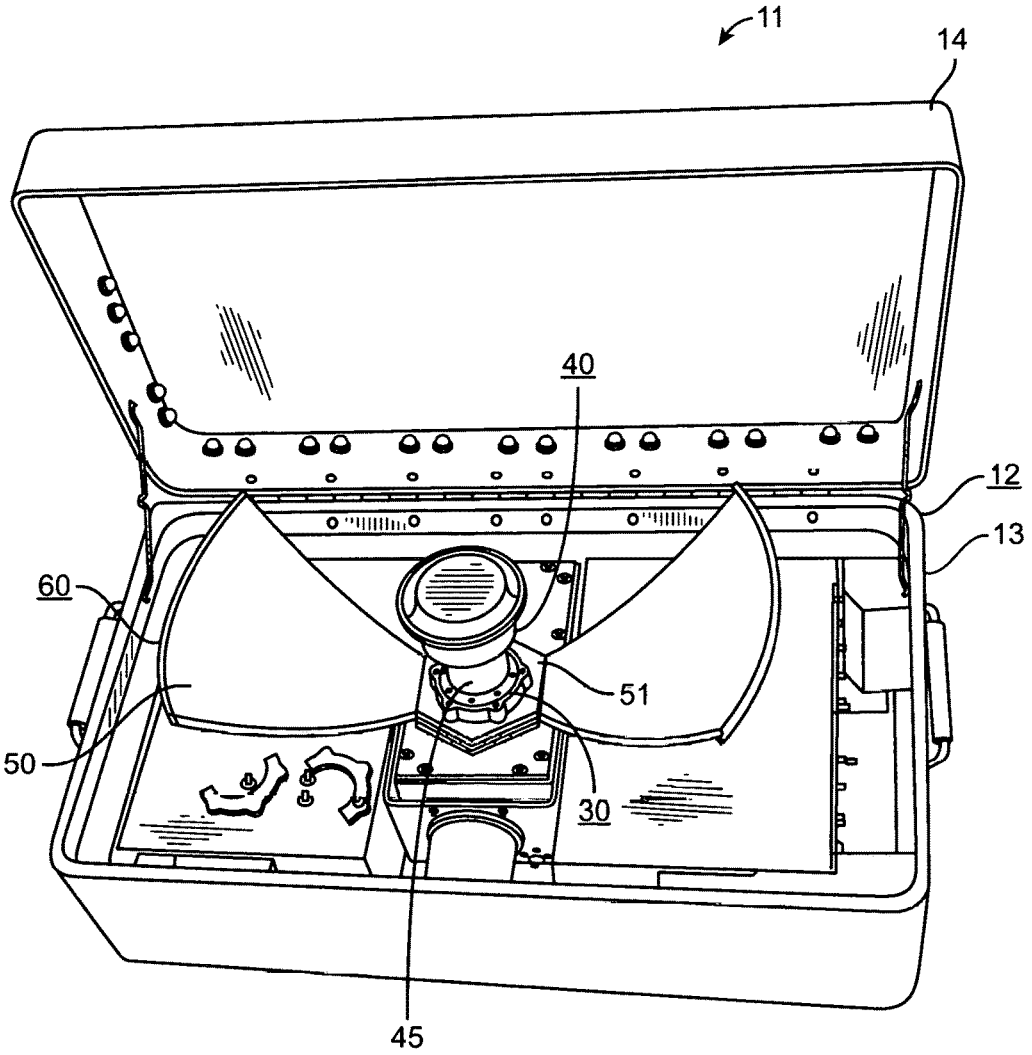
FIG. 29 is a perspective view of a portable, mobile communications apparatus, according to a further aspect of the disclosure, which comprises a protective enclosure for retractable access to a satellite feed structure, an antenna reflector unit, and an integrated device for mounting the feed structure to the reflector unit.
Figure 30:
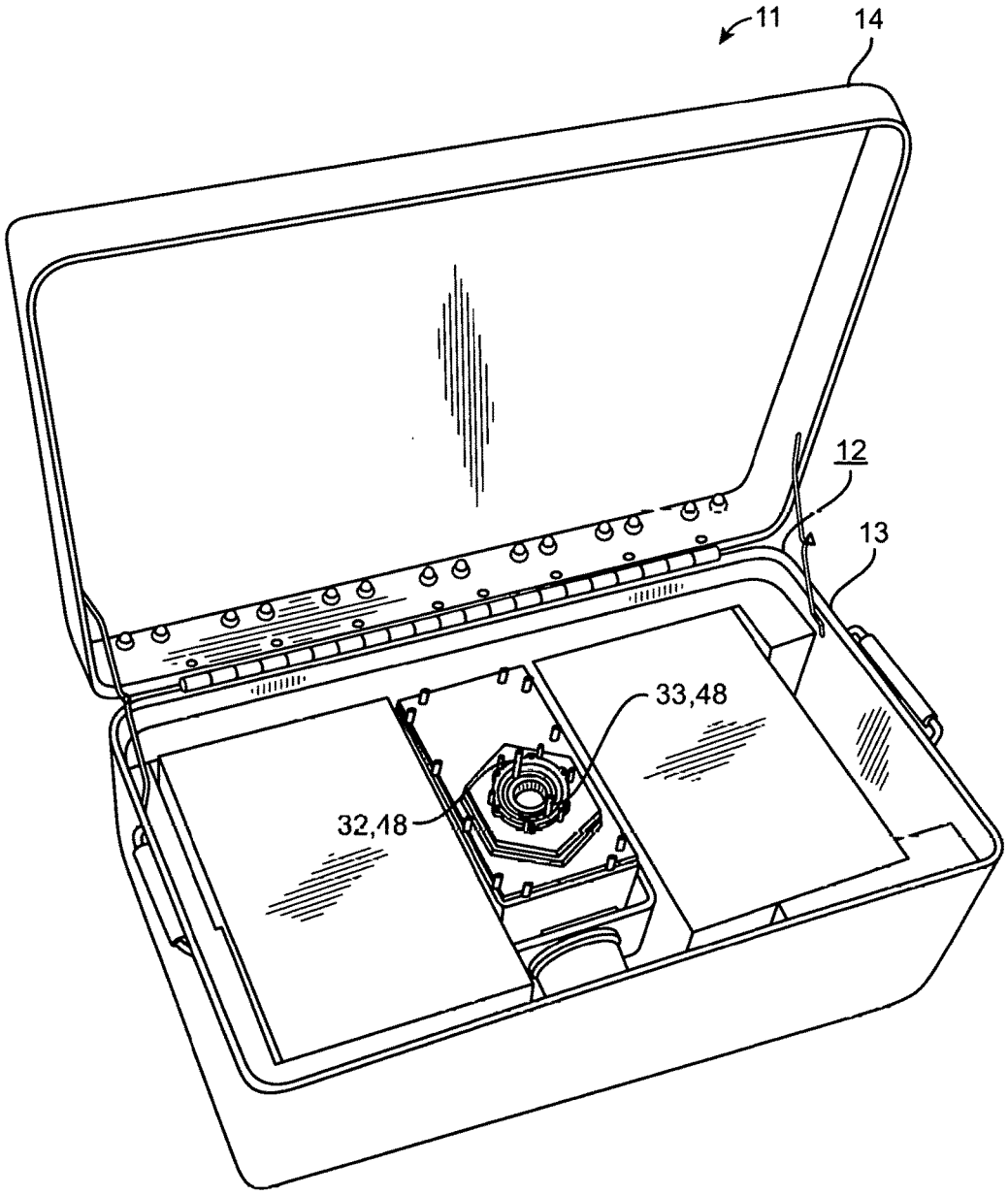
FIG. 30 is a perspective view of a cup component of the integrated device of FIG. 29, prior to assembly.

Referring now to the drawings and, more particularly, to FIGS. 1-30, there is shown generally a specific, illustrative apparatus 10, including an article 20 and integrated device 30, for releasably mounting a satellite antenna feed structure 40 to an antenna reflector unit 50, e.g., a collapsible dish antenna or the like. In one embodiment, illustrated generally in FIGS. 1-15, the device comprises a housing 31 associated with the feed structure and a cup 51 mounted to the antenna reflector unit. The housing includes a plurality of members 32, 33 projecting radially therefrom, the members being arranged and configured for cooperative engagement with slots 52, 53 correspondingly arranged and configured in the cup. According to one arrangement, the members protrude from the housing surface about 0.125 inch and have a width of approximately 0.156 inch, the members being positioned, for instance, about 0.375 inch from the base of the housing.

A resilient gasket 59 preferably lines at least a bottom internal surface of the cup. Upon positioning the housing axially relative to, and in mating engagement with, the cup, engaging the members with, and sliding them into, receiving ports 54, 55 of the slots, rotating the housing such that the members engage with and slide along the slots, and thereby biasing a mating portion 45 of the housing against the resilient gasket lining the cup bottom interior surface, so that the housing is engaged firmly within the cup by a frictional biasing force exerted by the lining, the feed structure is releasably secured to the reflector unit. Preferably, the slots in the cup are relatively horizontal with an angled, curvilinear entry portion 46 and generally collinear to one another for simultaneously and precisely guiding the members between stowed and operative positions.

According to another aspect of the disclosure, as shown in FIGS. 16-24, an article and integrated device are provided for mounting the satellite antenna feed structure to the antenna reflector unit. The device comprises housing 31 associated with the feed structure and cup 51 mounted to the antenna reflector unit. Specifically, the cup includes a plurality of inwardly projecting members 57, 58 arranged and configured for cooperative engagement with slots 52, 53 correspondingly arranged and configured in the housing. In one embodiment, the members are arranged on opposing sides of the cup and generally in alignment with one another, protruding inwardly from the cup interior surface about 0.14 inch and have a width of approximately 0.156 inch, the members being positioned, for instance, approximately 0.438 inch from the major cup opening.

Similarly, a resilient gasket 49 lines at least a bottom internal surface 56 of the cup. Upon positioning the housing axially relative to the cup and in mating engagement therewith, engaging the members with, and sliding them into, receiving ports 36, 37 of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. Desirably, the slots in the housing are relatively horizontal with an angled, curvilinear entry portion 38 and generally collinear to one another for simultaneously and precisely guiding the members between stowed and operative positions.

According to a further aspect of the disclosure, set forth in FIGS. 25-28, the article and integrated device again comprise the housing associated with feed structure 40 and the cup portion associated with an antenna assembly 60. Alternatively or concurrently, a plurality of members 61, 62 are mounted to antenna assembly 60, separately from the feed structure and the reflector unit, the assembly having a cup shaped portion 44 with resilient gasket 49 lining at least a bottom interior surface thereof. The members project inwardly or radially from the assembly and are arranged and configured for cooperative engagement with slots 63, 64 correspondingly arranged and configured in the feed structure, the reflector unit and/or component(s) thereof. Resilient gasket 49 lines at least a bottom internal surface of the cup portion. Upon positioning the housing axially relative to the cup portion and in mating engagement therewith, sliding the members into receiving ports 65, 66 of the slots, rotating the housing and/or cup portion such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots in the feed structure and/or reflector unit are relatively horizontal with an angled, curvilinear entry portion 67 and generally collinear to one another for simultaneously and precisely guiding the members between stowed and operative positions.

In general, the resilient gasket may be constructed of any resilient and/or pliable material, e.g., silicone, suitable for creating a cushion between mating parts and, in turn, a friction fit upon sandwiching the gasket between the parts, biasing one part against the other, and, in turn, holding the feed in place. According to one aspect of the disclosure, a 50 Durometer silicone gasket at a thickness of about 0.093 inches has been found particularly suitable for this purpose. Preferably, the gasket is provided with a conventional adhesive backing suitable for adherence to metallic surfaces such as aluminum alloys and/or polymeric materials, within the spirit and scope of the disclosure.

The cup, cup shaped portion, and housing, alternatively or concurrently therewith, are preferably constructed of a relatively light, durable material such as a selected alloy of aluminum or a polymeric material.

Although the present invention has been shown and described in connection with a resilient gasket for firm engagement of the housing in the cup or cup shaped portion, those skilled in the art will appreciate that other arrangements may be appropriately used for executing a force to hold the feed structure in place. For example, a bottom internal surface of the cup may, alternatively or concurrently, be filled with a resilient glue, resin or like adhesive suitable for providing holding forces between the cup and housing. Further in the alternative or concurrently therewith, a resilient or resistive material may be utilized in the bottom internal cup surface and/or on the cup sides, also within the spirit and scope of the present invention.

At the kernel of the disclosure is that the antenna must be able to rotate, e.g., 90 degrees, in the field because it changes signal reception as it rotates. Stated differently, antenna rotation, as facilitated by the disclosure, is intended as part of its use. In the context of use in the field and the needs of rugged use such as by soldiers, it is considered particularly important that there be no loose hardware, no tools such as screwdrivers, no screws and no bolts. By the various arrangements of the disclosure, and using a circular wave guide, the article, integrated device and apparatus are easier to package than prior assemblies, allow smaller packaging, yet enable quick assembly in the field for 90 degree rotation of the antenna, which is typically all that is needed.

Preferably, the slots used, according to various aspects of the disclosure, are principally horizontally oriented. A locking force may be provided by pushing down and twisting the housing into the cup such that the silicone gasket from below provides a frictional/biasing/holding force. As those skilled in the art will appreciate, it is considered relatively important that the connection be secure, not loose, and be watertight.

Additionally, notches 47 are provided in the housing or, in the alternative, the cup or cup portion of the disclosure provide precise alignment and movement to an exact point and then stop, rather than conventional connectors that rotate freely. In addition, a pin 48 fits in the corresponding cup, cup portion or housing for enabling precise alignment and, in turn, integration of the cup and housing components. It is preferred that pins be located in one of two positions on the components, as illustrated in the drawing figures, rather than randomly located thereabout.

Generally speaking, although the article, integrated device, apparatus and method of this disclosure has been shown and described with reference to an antenna and feed of conventional types, those skilled in the art will appreciate that other antenna and feed arrangements may be suitable, giving consideration to the purpose for which the disclosure is intended. In accordance with one aspect of the disclosure, the antenna is a product of Eclipse Corporation, and the feed is a product of Optimum Microwave, Inc. Additionally, while items are shown in the drawing figures as having particular dimensions and proportions, it will be understood that other dimensions and proportions are suitable, without departing from the scope and spirit of the disclousre.

Turning now to another aspect of the disclosure, a portable, mobile communications apparatus 11 is provided which comprises a protective enclosure 12 for retractable access to satellite feed structure 40, antenna reflector unit 50, and integrated device 30 for detachably mounting the feed structure to the reflector unit, the enclosure having a base 13 and a cover 14 hingedly attached to the base for accessing the structure, unit and device between open and closed positions. An arrangement of this general description is shown, for example, in FIGS. 29-30. The device comprises, in combination, housing 31 associated with the feed structure and cup 51 mounted to the antenna reflector unit. The housing includes the plurality of members 32, 33 projecting radially therefrom, the members being arranged and configured for cooperative engagement with slots correspondingly arranged and configured in the cup, resilient gasket 49 lining at least a bottom interior surface 56 of the cup. Upon positioning the housing axially relative to, and in mating engagement with, the cup, engaging the members with and sliding them into receiving ports of the slots, rotating the housing such that the members engage with and slide along the slots, and thereby biasing mating portion 45 of the housing against the resilient gasket lining of the cup bottom interior surface 56, so that the housing is engaged firmly within the cup by a frictional biasing force exerted by the lining, the feed structure is releasably secured to the reflector unit. The slots are relatively horizontal with an angled, curvilinear entry portion 46 and generally collinear to one another for simultaneously and precisely guiding the members between stowed and operative positions.

Alternatively or concurrently, the cup includes the plurality of inwardly projecting members 57, 58 arranged and configured for cooperative engagement with slots 52, 53 correspondingly arranged and configured in the housing, resilient gasket 49 lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing the mating portion 45 of the housing against the resilient gasket lining cup bottom interior surface 56, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

Further in the alternative or concurrently therewith, the plurality of members 61, 62 are mounted to antenna assembly 60, separately from the feed structure and the reflector unit, such members projecting inwardly or radially from the assembly. The members are arranged and configured for cooperative engagement with slots 63, 64 correspondingly arranged and configured in the feed structure, the reflector unit and/or component(s) thereof. Again, resilient gasket 49 lines at least bottom interior surface 56 of the cup portion. Upon positioning the housing axially relative to the cup and in mating engagement therewith, sliding the members into receiving ports 65, 66 of the slots, rotating the housing and/or cup such that the members engage with and slide along the slots, and thereby biasing mating portion 45 of the housing against the resilient gasket lining cup bottom interior surface 56, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

The various arrangements of this disclousre are advantageous in providing and/or facilitating a quick-connect feature for attaching a satellite antenna feed structure to an antenna reflector. The disclosure is also beneficial in requiring no tools or hardware for installation. The feed is simply inserted in the apparatus/device and given a simple twist, clockwise or counterclockwise to lock it in place. According to one arrangement set forth herein, locking is accomplished by a spring force created by compression of the silicone gasket during twisting of the feed, and pressure to create the compression on the gasket is created by the apparatus/device in the form of a specially designed groove that exerts more force as the twisting action is undertaken. According to embodiment, as described previously, the device comprises a cup like receptacle that has a special groove, and mating pins are provided on the feed assembly. In accordance with another, the special groove is provided on the feed assembly being attached, and the mating pins are in a cup-like receptacle of the hub/reflector assembly.

In operation, a method is provided for mounting a satellite antenna feed structure to an antenna reflector unit. Initially, the feed structure is provided with a housing, and a cup is associated with the antenna reflector unit. A plurality of members are then mounted to the housing and slots are formed in the cup. The members are mounted so as to project radially therefrom, being arranged and configured for cooperative engagement with slots correspondingly arranged, formed and configured in the cup, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

Alternatively or concurrently, the cup includes a plurality of inwardly projecting members arranged and configured for cooperative engagement with slots correspondingly arranged and configured in the housing, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

Further in the alternative or concurrently therewith, a plurality of members are mounted to the antenna assembly, separately from the feed structure and the reflector unit, such members projecting inwardly or radially from the assembly. The members are arranged and configured for cooperative engagement with slots correspondingly arranged and configured in the feed structure, the reflector unit and/or component(s) thereof, a resilient gasket lining at least a bottom interior surface of the cup. Upon positioning the housing axially relative to the cup and in mating engagement therewith, engaging the members with, and sliding them into, receiving ports of the slots, rotating the housing such that the members engage with and slide along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit. The slots are relatively horizontal with an angled, curvilinear entry portion and generally collinear to one another for simultaneously and precisely guiding the members between stowed and operative positions.

According to another alternative embodiment, a method is provided for dismounting a satellite antenna feed structure from an antenna reflector unit. First, a housing associated with the feed structure is grasped by the user, pushed in a generally downward direction so as to overcome a frictional biasing force, and rotated in a direction such that members projecting radially from the housing, which members are in engagement with slots in a cup associated with the antenna feed structure and have a resilient gasket lining at least a bottom portion thereof, slide along the slots. Second, rotation is continued by the user such that the members slide along the slots toward member receiving ports of the slots. Upon reaching and engaging the member receiving slots, the user pulls the housing axially, disengaging the members from the slots and the housing from the cup.

According to another aspect of this method, the user grasps the housing associated with the feed structure, pushes the housing pushed in a generally downward direction so as to overcome a frictional biasing force, and rotates it in a direction such that members projecting inwardly from a cup associated with the antenna reflector unit, which members are in engagement with slots in the housing, slide along the slots. Rotation is then continued such that the members slide along the slots toward member receiving ports of the slots. Upon reaching and engaging the member receiving slots, the user pulls the housing axially, disengaging the members from the slots and the housing from the cup.

In the case where the members project inwardly or radially from an antenna assembly, which members are in engagement with slots in the feed structure, reflector unit and/or component(s) thereof, the user similarly pushes the housing in a generally downward direction so as to overcome a frictional biasing force, and rotates the same such that the members slide along the slots. Rotation is continued such that the members slide along the slots toward member receiving ports of the slots. Upon reaching and engaging the member receiving slots, grasping the housing and disengaging the members from the slots and the housing from the antenna assembly.

Referring now to an additional arrangement, a portable, remotely deployable assembly is provided, which comprises, in combination, a weatherproof, waterproof, battleproof, handheld/handle and/or body supported/strap case housing operative portions of the above-described embodiments including antenna feed structure, housing and mounting cup as well as assembly comprising, in combination, foldable and/or multi-part, assembliable antenna reflector unit.

Overall, using the quick-connection feature according to the present invention for an antenna feed, assembly time is reduced from several minutes or more (in the case of hardware mounting) to seconds.

Various modifications and alterations may be appreciated based on a review of this disclosure. These changes and additions are intended to be within the scope and spirit thereof.

What is claimed is:

1. An article for detachably mounting a satellite antenna feed structure to an antenna reflector unit, the article comprising a housing associated with the feed structure, the housing including a plurality of members projecting radially therefrom arranged and configured for cooperative engagement with laterally extending slots correspondingly arranged and configured in a cup mounted to the antenna reflector unit, a resilient gasket lining at least a bottom interior surface of the cup, whereupon positioning the housing axially relative to, and in mating engagement with, the cup, engaging the members with, and sliding them into, receiving ports of the slots, rotating the housing such that the members engage with and slide laterally along the slots, and thereby biasing a mating portion of the housing against the resilient gasket lining of the cup bottom interior surface, so that the housing is engaged firmly within the cup by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

2. An integrated device for detachably mounting a satellite antenna feed structure to an antenna reflector unit, the device comprising, in combination, a housing associated with the feed structure and a cup mounted to the antenna reflector unit, the housing including a plurality of members projecting radially therefrom, the members being arranged and configured for cooperative engagement with laterally extending slots correspondingly arranged and configured in the cup, a resilient gasket lining at least a bottom interior surface of the cup, whereupon positioning the housing axially relative to, and in mating engagement with, the cup, engaging the members with and sliding them into receiving ports of the slots, rotating the housing such that the members engage with and slide laterally along the slots, and thereby biasing a mating portion of the housing against the resilient gasket lining of the cup bottom interior surface, so that the housing is engaged firmly within the cup by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

3. A portable, mobile communications apparatus comprising a protective enclosure for retractable access to a satellite feed structure, an antenna reflector unit, and an integrated device for detachably mounting the feed structure to the reflector unit, the enclosure having a base and a cover hingedly attached to the base for accessing the structure, unit and device between open and closed positions, the device comprising, in combination, a housing associated with the feed structure and a cup mounted to the antenna reflector unit, the housing including a plurality of members projecting radially therefrom, the members being arranged and configured for cooperative engagement with laterally extending slots correspondingly arranged and configured in the cup, a resilient gasket lining at least a bottom interior surface of the cup, whereupon positioning the housing axially relative to, and in mating engagement with, the cup, engaging the members with and sliding them into receiving ports of the slots, rotating the housing such that the members engage with and slide laterally along the slots, and thereby biasing a mating portion of the housing against the resilient gasket lining of the cup bottom interior surface, so that the housing is engaged firmly within the cup by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

4. An article for detachably mounting a satellite antenna feed structure to an antenna reflector unit, the article comprising a cup mounted to the antenna reflector unit, the cup having a plurality of inwardly projecting members arranged and configured for cooperative engagement with laterally extending slots correspondingly arranged and configured in a housing associated with the feed structure, a resilient gasket lining at least a bottom interior surface of the cup, whereupon positioning the housing axially relative to the cup and in mating engagement therewith, engaging the members with, and sliding them into, receiving ports of the slots, rotating the housing such that the members engage with and slide laterally along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

5. An integrated device for detachably mounting a satellite antenna feed structure to an antenna reflector unit, the device comprising, in combination, a housing associated with the feed structure and a cup of the antenna reflector unit, the cup including a plurality of inwardly projecting members arranged and configured for cooperative engagement with laterally extending slots correspondingly arranged and configured in the housing, a resilient gasket lining at least a bottom interior surface of the cup, whereupon positioning the housing axially relative to the cup and in mating engagement therewith, engaging the members with, and sliding them into, receiving ports of the slots, rotating the housing such that the members engage with and slide laterally along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

6. A portable, mobile communications apparatus comprising a protective enclosure for retractable access to a satellite feed structure, an antenna reflector unit, and an integrated device for detachably mounting the feed structure to the reflector unit, the enclosure having a base and a cover hingedly attached to the base for accessing the structure, unit and device between open and closed positions, the device comprising, in combination, a housing associated with the feed structure and a cup of the antenna reflector unit, the cup including a plurality of inwardly projecting members arranged and configured for cooperative engagement with laterally extending slots correspondingly arranged and configured in the housing, a resilient gasket lining at least a bottom interior surface of the cup, whereupon positioning the housing axially relative to the cup and in mating engagement therewith, engaging the members with, and sliding them into, receiving ports of the slots, rotating the housing such that the members engage with and slide laterally along the slots, and thereby biasing a mating portion of the housing against the resilient gasket lining the cup bottom interior surface, so that the housing is engaged firmly within the cup by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

7. An article for detachably mounting a satellite antenna feed structure to an antenna reflector unit of an antenna assembly, the article comprising an antenna assembly mounting a plurality of members projecting inwardly or radially therefrom, and separately from the feed structure and the reflector unit, the antenna assembly having a cup shaped portion with a resilient gasket lining at least a bottom interior surface thereof, the members being arranged and configured for cooperative engagement with laterally extending slots correspondingly arranged and configured in the feed structure, the reflector unit or component(s) thereof, whereupon positioning the housing axially relative to the cup portion and in mating engagement therewith, sliding the members into receiving ports of the slots, rotating the housing or cup portion such that the members engage with and slide laterally along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

8. An integrated device for detachably mounting a satellite antenna feed structure to an antenna reflector unit, the device comprising, in combination, a housing associated with the feed structure and a cup shaped portion of the antenna assembly, a plurality of members being mounted to the antenna assembly, separately from the feed structure and the reflector unit, such members projecting inwardly or radially from the assembly, the members being arranged and configured for cooperative engagement with laterally extending slots correspondingly arranged and configured in the feed structure, the reflector unit, or component(s) thereof, a resilient gasket lining at least a bottom interior surface of the cup portion, whereupon positioning the housing axially relative to the cup portion and in mating engagement therewith, sliding the members into receiving ports of the slots, rotating the housing or cup portion such that the members engage with and slide laterally along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

9. A portable, mobile communications apparatus comprising a protective enclosure for retractable access to a satellite feed structure, an antenna reflector unit of an antenna assembly, and an integrated device for detachably mounting the feed structure to the reflector unit, the enclosure having a base and a cover hingedly attached to the base for accessing the structure, unit and device between open and closed positions, the apparatus comprising, in combination, a housing associated with the feed structure and a cup shaped portion of the antenna assembly, a plurality of members being mounted to the antenna assembly, separately from the feed structure and the reflector unit, such members projecting inwardly or radially from the assembly, the members being arranged and configured for cooperative engagement with laterally extending slots correspondingly arranged and configured in the feed structure, the reflector unit, or component(s) thereof, a resilient gasket lining at least a bottom interior surface of the cup portion, whereupon positioning the housing axially relative to the cup portion and in mating engagement therewith, sliding the members into receiving ports of the slots, rotating the housing or cup portion such that the members engage with and slide laterally along the slots, and thereby biasing a mating portion of the housing against the resilient gasket lining the cup portion bottom interior surface, so that the housing is engaged firmly within the cup portion by a frictional biasing force exerted by the lining, the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

10. A method for detachably mounting a satellite antenna feed structure to an antenna reflector unit, which comprises the steps of:

i. providing the feed structure with a housing, and associating a cup with the antenna reflector unit;

ii. mounting a plurality of members to the housing and forming laterally extending slots in the cup, the members being mounted so as to project radially therefrom, being arranged and configured for cooperative engagement with the slots, the slots being correspondingly arranged and configured in the cup; and iii. positioning the housing axially relative to the cup and in mating engagement therewith;

iv. engaging the members with, and sliding them into, receiving ports of the slots; and v. rotating the housing such that the members engage with and slide laterally along the slots such that the housing is engaged firmly with the cup, and the feed structure releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

11. A method for detachably mounting a satellite antenna feed structure to an antenna reflector unit, which comprises the steps of:

i. providing the feed structure with a housing, and associating a cup with the antenna reflector unit;

ii. mounting a plurality of members to the cup and forming laterally extending slots in the housing, the members being mounted so as to project inwardly therefrom, the members being arranged and configured for cooperative engagement with the slots, the slots being correspondingly arranged and configured in the housing;

iii. positioning the housing axially relative to the cup and in mating engagement therewith;

iv. engaging the members with, and sliding them into, receiving ports of the slots; and v. rotating the housing such that the members engage with and slide laterally along the slots so that the housing is engaged firmly with the cup, and the feed structure is releasably secured to the reflector unit, the slots being elongated and generally perpendicular to an axis of rotation of the housing, with an angled, curvilinear entry portion and generally collinear to one another for simultaneously and precisely guiding the members between selected positions each for achieving optimal orientation for signal reception by the antenna reflector unit.

12. A method for detachably mounting a satellite antenna feed structure to an antenna reflector unit of an antenna assembly, which comprises the steps of:

i. providing the feed structure with a housing, and associating a cup shaped portion with the antenna assembly;

ii. mounting a plurality of members to the antenna assembly, separately from the feed structure and the reflector unit, and forming laterally extending slots in the feed structure, the reflector unit or component(s) thereof, the members projecting radially from the assembly, the members being arranged and configured for cooperative engagement with the slots, the slots being correspondingly arranged and configured in the feed structure or the reflector unit;

iii. positioning the housing axially relative to the cup and in mating engagement therewith;

iv. engaging the members with, and sliding them into, receiving ports of the slots; and v. rotating the housing such that the members engage with and slide laterally along the slots so that the housing is engaged firmly with the cup portion, and the feed structure is releasably secured to the reflector unit, the slots being elongated and generally perpendicular to an axis of rotation of the housing, an angled, curvilinear entry portion and generally collinear to one another for simultaneously and precisely guiding the members between selected positions each for achieving optimal orientation for signal reception by the antenna reflector unit.

13. A method for dismounting a satellite antenna feed structure from an antenna reflector unit, which comprises the steps of:

i. grasping a housing associated with the feed structure;

ii. pushing the housing in a generally downward direction so as to overcome a frictional biasing force, iii. rotating the housing in a direction such that members projecting radially from the housing, which members are in engagement with laterally extending slots in a cup associated with the antenna feed structure, slide laterally along the slots;

iv. continuing rotation set forth in step i. above such that the members slide laterally along the slots toward member receiving ports of the slots, each port corresponding to a position for achieving optimal orientation for signal reception by the antenna reflector unit; and v. upon reaching and engaging the member receiving slots, pulling the housing and disengaging the members from the slots and the housing from the cup.

14. A method for dismounting a satellite antenna feed structure from an antenna reflector unit, which comprises the steps of:

i. grasping a housing associated with the feed structure;

ii. pushing the housing in a generally downward direction so as to overcome a frictional biasing force;

iii. rotating the housing in a direction such that members projecting inwardly from a cup associated with the antenna reflector unit, which members are in engagement with laterally extending slots in the housing, slide laterally along the slots;

iv. continuing rotation set forth in step i. above such that the members slide laterally along the slots toward member receiving ports of the slots, each port corresponding to a position for achieving optimal orientation for signal reception by the antenna reflector unit; and v. upon reaching and engaging the member receiving slots, pulling the housing and disengaging the members from the slots and the housing from the cup.

15. A method for dismounting a satellite antenna feed structure from an antenna reflector unit, which comprises the steps of:

i. grasping a housing associated with the feed structure;

ii. pushing the housing in a generally downward direction so as to overcome a frictional biasing force;

iii. rotating the housing in a direction such that members projecting inwardly or radially from an antenna assembly, which members are in engagement with laterally extending slots in the feed structure, reflector unit or component(s) thereof, slide laterally along the slots;

iv. continuing rotation set forth in step i. above such that the members slide laterally along the slots toward member receiving ports of the slots, each port corresponding to a position for achieving optimal orientation for signal reception by the antenna reflector unit; and v. upon reaching and engaging the member receiving slots, pulling the housing and disengaging the members from the slots and the housing from the antenna assembly.

* * * * *